US010412999B1

(12) United States Patent
Garcia

(10) Patent No.: US 10,412,999 B1
(45) Date of Patent: Sep. 17, 2019

(54) GIRL'S DRESS FROM MAN'S DRESS SHIRT

(71) Applicant: Maria Cielo Garcia, Hoboken, NJ (US)

(72) Inventor: Maria Cielo Garcia, Hoboken, NJ (US)

( * ) Notice: Subject to any disclaimer, the term of this patent is extended or adjusted under 35 U.S.C. 154(b) by 195 days.

(21) Appl. No.: 15/612,469

(22) Filed: Jun. 2, 2017

(51) Int. Cl.

| | |
|---|---|
| ***A41D 1/22*** | (2018.01) |
| ***A41D 11/00*** | (2006.01) |
| ***A41B 1/08*** | (2006.01) |
| ***A41B 13/08*** | (2006.01) |

(52) U.S. Cl.
CPC ..... *A41D 1/22* (2013.01); *A41B 1/08* (2013.01); *A41B 13/08* (2013.01); *A41D 11/00* (2013.01)

(58) Field of Classification Search
CPC ..... A41D 11/00; A41B 1/08; A41B 13/08
USPC ..... 2/69, 75; 112/402, 440, 475.09, 475.14
See application file for complete search history.

(56) References Cited

U.S. PATENT DOCUMENTS

| | | | | | |
|---|---|---|---|---|---|
| 2,694,201 | A * | 11/1954 | Carson | A41B 13/00 | 2/105 |
| 2,722,010 | A * | 11/1955 | Thielman | A41D 15/00 | 2/75 |
| 2,943,330 | A | 7/1960 | Clyne | | |
| 5,628,064 | A | 5/1997 | Chung | | |
| 5,842,230 | A * | 12/1998 | Laudick | A41D 1/18 | 2/69 |
| 7,814,574 | B2 | 10/2010 | Gheneva | | |
| 9,210,957 | B2 | 12/2015 | Conde et al. | | |
| 9,364,035 | B1 | 6/2016 | Shachaf | | |
| 2008/0307556 | A1 | 12/2008 | Turney | | |
| 2009/0223427 | A1 * | 9/2009 | Turney | A41B 13/00 | 112/475.09 |

OTHER PUBLICATIONS www.lifeisbeautiful.com "DIY Men's XL shirt into a little girl's dress" 34 pages (Year: 2014).*
How to transform old shirts into adorable summer dresses for girls, article, http://brightside.me/,15 pages, Accessed Apr. 27, 2017.
Turn one of Daddy's Shirts Into a Dress for a Little Girl, article, http://www.goodshomedesign.com/, 5 pages, Accessed Apr. 27, 2017.

* cited by examiner

*Primary Examiner* — Katherine M Moran
(74) *Attorney, Agent, or Firm* — Michael J. Feigin, Esq.; Feigin and Fridman LLC

(57) ABSTRACT

A dress created from a shirt is disclosed, such as a dress for an infant, toddler, or small girl created from a man's button-down shirt. The shirt is cut horizontally with a portion below the cut forming a skirt with pleats formed by partially deforming and closing the top side of the skirt while it sewed to a torso of the dress. The torso is also cut from the same shirt, having two arm holes and a front and back side sewn together but being, in embodiments, reversed from the front and back side of the shirt in order that a placket of the button-down shirt is split with a portion in the back side of the torso and a portion in the front side of the skirt in embodiments of the disclosed technology.

12 Claims, 5 Drawing Sheets

GIRL'S DRESS FROM MAN'S DRESS SHIRT

FIELD OF THE DISCLOSED TECHNOLOGY

The disclosed technology relates generally to making clothing, and more specifically to methods of making dresses.

SUMMARY OF THE DISCLOSED TECHNOLOGY

A dress of embodiments of the disclosed technology is made by severing (completely cutting across until two pieces of previously joined material are disconnected from one another entirely) from a shirt a longitudinal length thereof. This can be a lowest section of the shirt (such as the bottom ⅓ of the shirt, or substantially thereof). This can be another section of the shirt, in which case it is cut longitudinally in two places. When it is the lowest section of the shirt, only one longitudinal cut to sever need be implemented. This longitudinal length has there-on a placket extending transverse (generally perpendicular) to the direction of cutting. The placket, or a portion of what was the placket of the shirt, has at least one or two buttons and extends the length of the longitudinal section from top to bottom, where "top", "bottom", and other directional terms used in this disclosure are with respect to the dress where the skirt is on the "bottom" of the dress and the torso is on the "top" of the dress. Similarly, when referring to a shirt, the "top" of the shirt is at the collar/neck region and the "bottom" is adapted to be placed over a lower torso (generally) or closest to the center of earth when worn.

From a portion of the shirt other than the longitudinal length subject to the severing, such as from above said length, a torso section of a dress having a portion of the placket is created. This torso section is reconnected with the longitudinal length such that the longitudinal length is rotated with respect to the torso compared to their respective original orientations when part of the shirt. In some embodiments, they are rotated so that there is a row of buttons on the front side of the skirt and a row of buttons on the back side of the torso. The latter are used when putting on or taking off the dress. As such, the longitudinal length of the shirt which has been severed becomes the skirt of the dress in some embodiments.

Before or during the step of reconnecting what becomes the torso to the skirt, pleats are created. This narrows the top side of the skirt to fit with a narrower torso, while the bottom side of the skirt remains wider, creating an A-line figure with angled sides of the skirt, compared to a straight up- and -down torso.

A collar of the dress can be created by either taking a portion or all of a collar of the shirt and attaching same to the torso, or leaving the collar or a portion thereof intact with the torso portion. Or, a collar can be separately cut and attached to the torso. The collar can then cover part of the torso when it is folded down there-over, except for, in some embodiments, a region of the torso which has the placket. A "placket" is defined, for purposes of this disclosure, as "an opening or slit in the shirt or dress covering fastenings, giving access to an area under the fabric, or the flap of fabric which creates an opening therein." In some embodiments, stitching there-around and/or different material sewn to the rest (even if matching in pattern) signifies the bounds of a placket or placket region.

The dress of embodiments of the disclosed technology thus has a skirt formed from a section of a shirt which was longitudinally cut across a length thereof, and a torso section having a width, at least in part, less than that of the skirt. A portion of a placket from the shirt now is on the skirt and extends transverse to the cut across the length of the shirt.

A portion of a placket from one of the shirt used for the skirt or another shirt extends along the torso generally in parallel to the placket of the skirt in some embodiments. In some embodiments, these two portions of placket which were on the same side or from the same length of placket of a single shirt, are now on opposite sides of the dress, such as a front side of the skirt and back side of the torso. The front and back being defined as how the dress would ordinarily be worn.

Pleats are created on the skirt, in embodiments of the disclosed technology, which reach to a top of the skirt which is where the skirt joins with the torso. This creates a narrower width of skirt at a top side than a bottom side. As such, a widest width of the skirt can be at the bottom of skirt whereas the widest width of the torso is equal or substantially equal to that of the narrowest width of the skirt. The "width" is the "right and left" direction which is perpendicular to the direction of the plackets and/or which is longitudinal and/or which is perpendicular to a line passing from a top to a bottom of the dress. One can open the plackets and re-close them, as needed to put on or take off the dress.

Any device or step to a method described in this disclosure can comprise or consist of that which it is a part of, or the parts which make up the device or step. The term "and/or" is inclusive of the items which it joins linguistically and each item by itself. "Substantially" and "generally" is defined as "at least 95% of the term being described" and any device or aspect of a device or method described herein can be read as "comprising" or "consisting" thereof.

BRIEF DESCRIPTION OF THE DRAWINGS

FIG. 2 shows a portion of a torso section of a dress which has been cut from a man's shirt in embodiments of the disclosed technology.

DETAILED DESCRIPTION OF EMBODIMENTS OF THE DISCLOSED TECHNOLOGY

A dress created from a shirt is disclosed, such as a dress for an infant, toddler, or small girl created from a man's button-down shirt. The shirt is cut horizontally with a portion below the cut forming a skirt with pleats formed by partially deforming and closing the top side of the skirt while it sewed to a torso of the dress. The torso is also cut from the same shirt, having two arm holes and a front and back side sewn together but being, in embodiments, reversed from the front and back side of the shirt in order that a placket of the button-down shirt is split with a portion in the back side of the torso and a portion in the front side of the skirt in embodiments of the disclosed technology.

Embodiments of the disclosed technology will become clearer in view of the following description of the figures.

Figure 1:
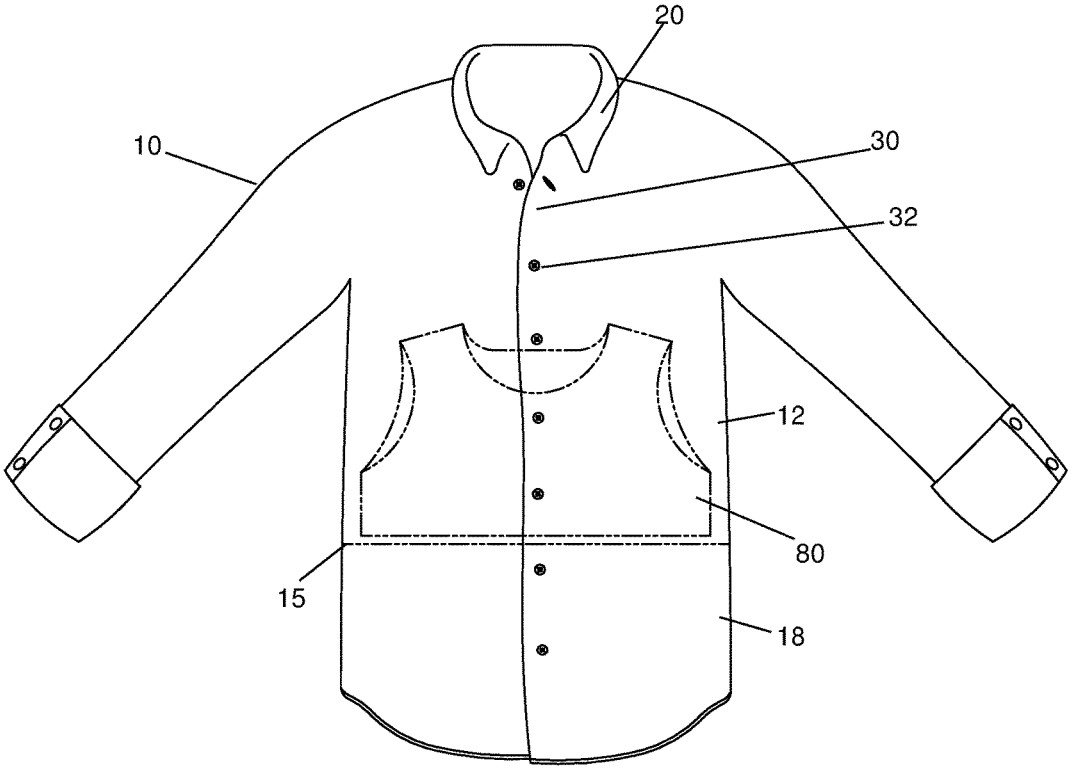
FIG. 1 shows a man's shirt with regions cut out to form a girl's dress in embodiments of the disclosed technology.

FIG. 1 shows a man's shirt with regions cut out to form a girl's dress in embodiments of the disclosed technology. The man's shirt 10 is any garment designed to be worn which covers the torso, back, and at least a portion of the shoulders. In embodiments, it is a "button-down" shirt having a placket 30 (see definition in the "summary") which allows the shirt to open and close partially or fully along an axis which runs from the top to the bottom of the shirt. The "top" of the shirt is the portion of the shirt designed to be at the top when worn by a person standing. The "bottom" of the shirt is designed to be at the bottom when worn by a person standing. Thus, the collar 20 is at the top in the embodiment shown in FIG. 1 and the lower region 18 which will become the skirt is at the bottom.

Note that the skirt 18 of the dress which will be created from this shirt can be from the bottom most portion of the shirt, as shown, or another portion of the shirt. The skirt extends circumferentially, from a circumferential section of the shirt, such as one cut latitudinally (horizontally) around the shirt such that the placket 30 will run longitudinally (vertically) down some or all of the skirt 18. In this manner, the placket 30 with a male fastener 32 becomes part of the design of the skirt, allowing the skirt to open and close vertically partially or fully. The skirt 18 cut from the bottom of the shirt 18 (same number because, as shown in FIG. 1, the bottom of the shirt and skirt are identical) can be cut along a horizontal or latitudinal line 15, creating a torus of material or belled cylinder/bell-shaped cylinder (narrower top side, winder bottom side as part of a cylinder) which is the skirt.

Figure 2:
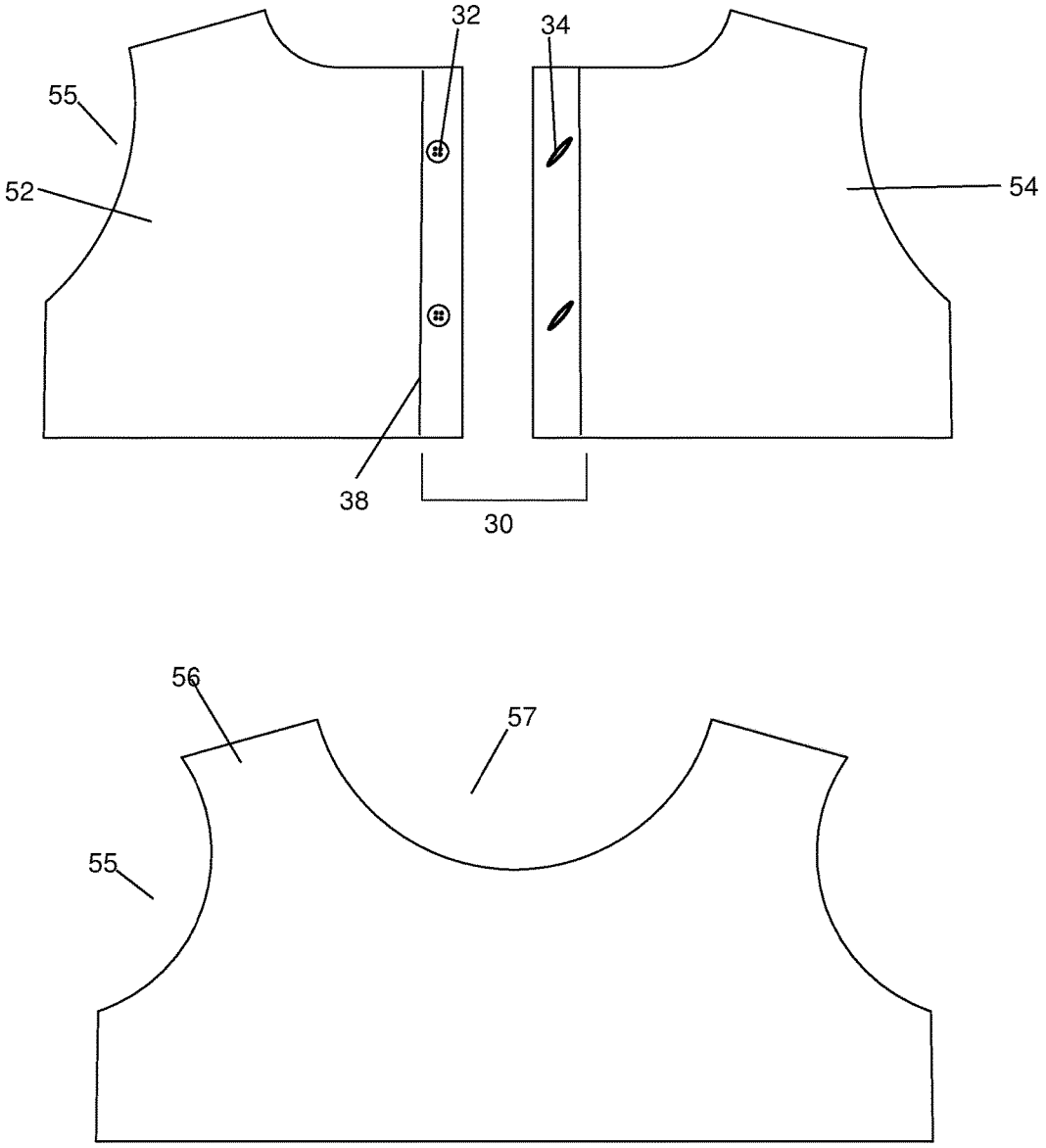
FIG. 2 shows a pattern used to cut a torso section of a dress from the man's shirt. Alternatively.

The torso of the dress 80 is cut out of another portion of the shirt and either extends as a torus in a circular length of material, as the skirt 18 does, and as shown in FIG. 1, or is cut with a front side and back side separate from each other as shown in FIG. 2. The placket 30 is midway between the arm holes of the torso 80. Another way of describing the position of the placket 30 in the torso 80 section of the dress is that the placket is centered on the front side of the shirt and back side of the dress (the dress is flipped 180 degrees with respect to its position on the shirt in embodiments of the disclosed technology). The placket 30 of the shirt can become the way the dress is opened from the back side of the dress.

FIG. 2 shows a pattern used to cut a torso section of a dress from the man's shirt. Alternatively, FIG. 2 shows a portion of a torso section of a dress which has been cut from a man's shirt in embodiments of the disclosed technology. Here, one can see the placket 30 is a region of the torso of the dress, in the top picture which can represent what was cut from a front side of the shirt 10 and/or what will become the back side of the dress. The "front" is the side which is designed to be worn on a front side of a wearer while the "back" is the side which is designed to be worn on the back side of the wearer. Even if "worn backwards" the placket of the torso of the dress will, in embodiments, be on an opposite side as a placket of the skirt of the dress, the dress being the entire article of clothing created while the "skirt" refers to a portion which is designed to or does hang down over the legs of a wearer while being held to the wearer by a torso section of the dress and/or waist area at the top of the skirt which is held up by the hips of the wearer.

The back side of the torso region of the dress (top half of FIG. 2) is broken up into a left side 52 and right side 54. The front side 46 is continuous in embodiments. Further, the front side and back side can join together below the arm holes and be on continuous loop, either by way of sewing the portions 52 and 54 separately to opposite sides of section 56 after they are cut from the shirt 10, or by having them sewn continuously when part of shirt 10 and remaining so after the cutting of the torso 80 from the shirt. The arm cutouts 55 can be curvilinear or curved around a circular or oval shape. The neck cutout 57 can also be curvilinear or curved around a circular or oval shape, with the radius of the circle or oval being larger in the cutout region of the neck 57 than the cutout region of the arms 55. Flat top-sides of the shoulders and flat horizontal-sides of the torso may be between or adjacent to the cutouts 55 and 57.

Note that the placket 30 can be a region delineated by a stitching line 38 or change in the fabric (thickness, color, direction of stitching, number of fabric layers, or the like). The placket has, in embodiments of the disclosed technology, at least some male connectors 32 and at least some female connectors 34. In this manner, the placket can be used to connect the two sides 52 and 54 of the torso 80 together, this being the back side of the dress in embodiments of the disclosed technology. Note the back side of the dress can be delineated by a higher rise of the central region between the shoulders than the front side 56. Thus, the dress may cover a higher area of the back or neck of the wearer in the back than in the front.

Figure 3:
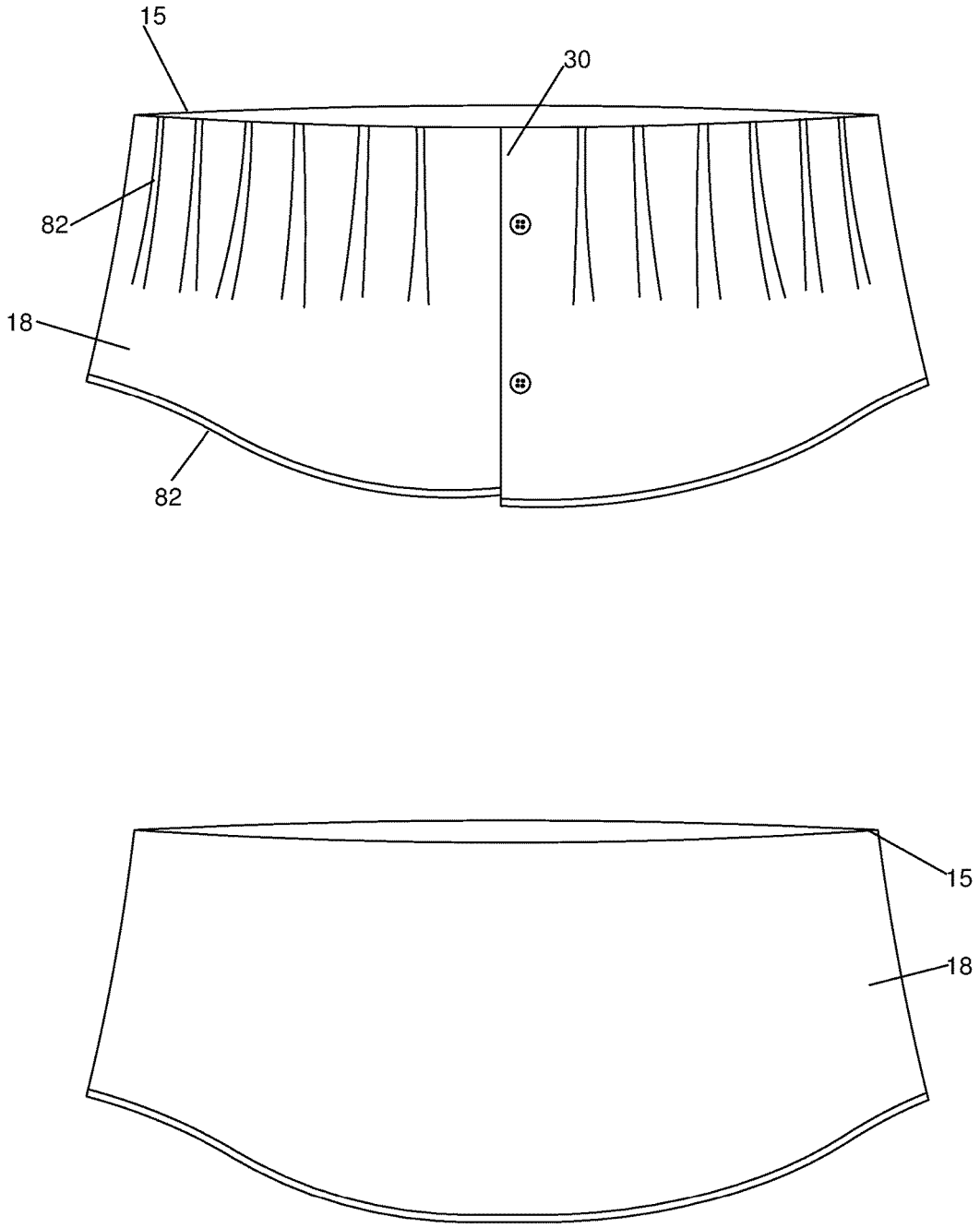
FIG. 3 shows a bottom portion of a man's shirt with pleats used in a skirt of a dress in embodiments of the disclosed technology.

FIG. 3 shows a bottom portion of a man's shirt with pleats used in a skirt of a dress in embodiments of the disclosed technology. The top drawing shows a front side of the skirt while the bottom drawing shows a back side of the skirt, of embodiments of the disclosed technology. Below the horizontal cut line 15 and above either: a) a bottom 82 of the shirt 10 or b) a bottom cut line 82 from the shirt 10 a skirt 18 is created. The shirt can be pleated with pleats 82 such that the top side is narrower than the bottom side and the skirt fans out or forms an A-line. This mimics the look of a skirt, and in fact, becomes a skirt, which typically is narrower at the top by the waist than at the bottom, such as when the bottom is adjacent to or adapted to cover a thigh, knee, or ankle. It should further be understood that the dress created can have a torso, skirt, and/or collar which are cut from the same shirt 10 or, in an alternative embodiment, each or at least one of these elements from a different shirt than the first shirt 10.

Note also that the placket 30 of the shirt forms a portion of the skirt 18. This placket has at least one, two, or three fasteners (a single or plurality of fasteners) just as the placket portion which becomes part of the torso of the dress has a single or plurality of fasteners. The skirt can be a continuous length of fabric, from a continuous length of shirt (where seams can help create the continuous nature of the fabric) except for the placket region 30 which creates an area where the skirt can be opened or closed in the vertical direction.

Figure 4:
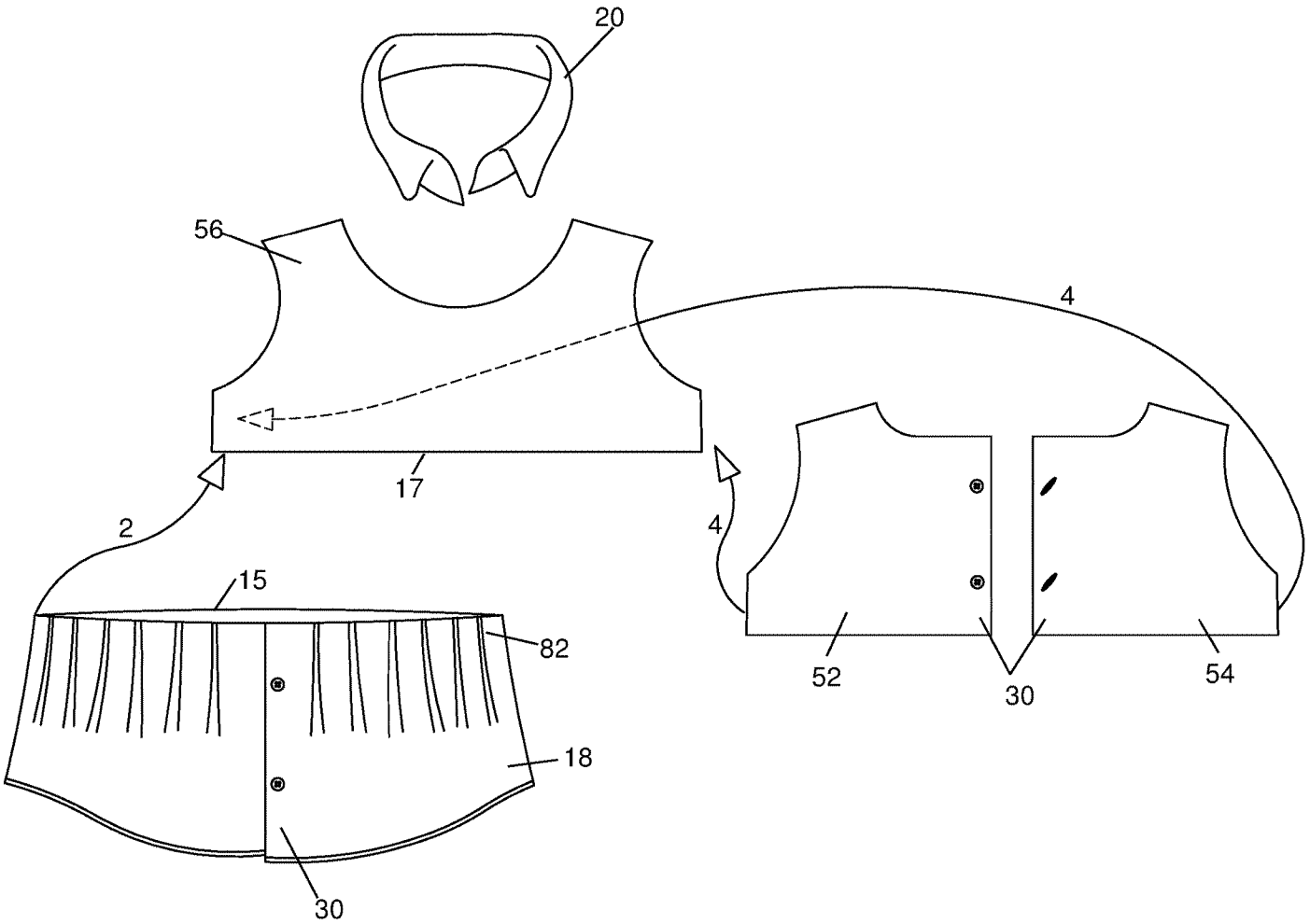
FIG. 4 shows how the portions of the man's shirt are re-arranged and attached to form a dress in embodiments of the disclosed technology.

FIG. 4 shows how the portions of the man's shirt are rearranged and attached to form a dress in embodiments of the disclosed technology. The collar 20 can remain integrally connected to the shirt throughout. That is, the collar can be sewn into the shirt, worn as a shirt, and then remain connected to the torso region 80 even after the conversion into a dress. However, typically the collar is disconnected from the shirt and turned around 180 degrees relative to the torso region 80 of the dress so that collar faces forward (it's opening at the front of the wearer, or designed as such) whereas the placket 30 of the torso region which was at the front of the shirt, becomes the back of the dress.

The back portions 52 and 54 of the torso region are connected to the front portion 56 of the torso region as indicated by the arrows 4 with the side-most extremities joined together, if they have not remained joined together when cut from the shirt. Typically, the front and back side are joined together anew because the width of the dress, such as one worn by a child (e.g. daughter of the owner of the shirt) is less than that of the shirt 10 (e.g. because the man has a much bigger torso than the daughter). The bottom region/skirt 18 is joined to the torso region such that the top side 15 of the bottom region 18 follows arrow 2 to join with the bottom side 17 of the torso region. While arrow 2 points to just the front side 56 of the torso 80, it should be understood that additionally, the back sides 52 and 54 of the torso region 80 is joined with the top side 15. This joining, and joining of each of the parts in fact, is accomplished in embodiments of the disclosed technology by way of sewing and/or stitching the pieces of fabric together.

Figure 5:
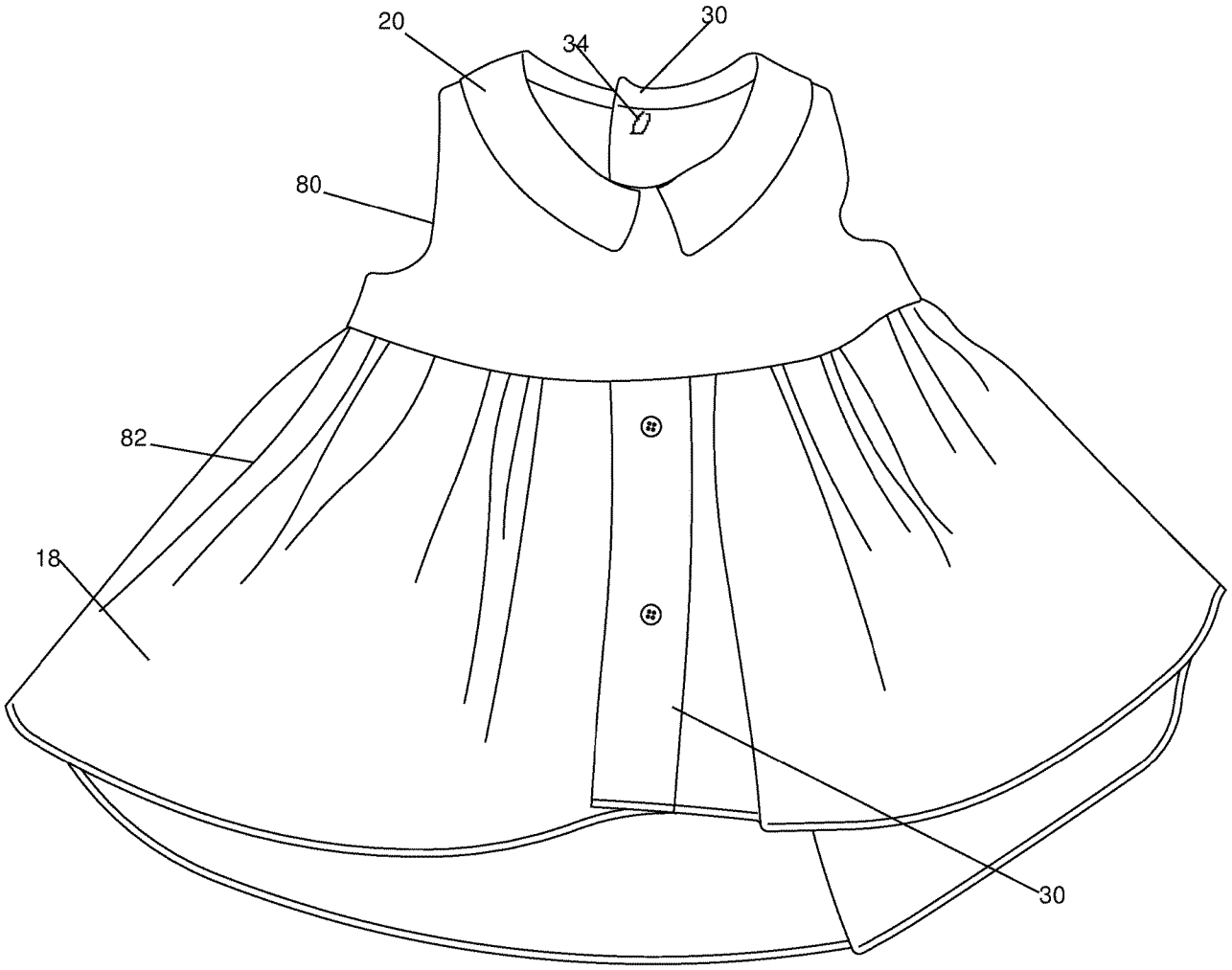
FIG. 5 shows a dress created from the man's shirt in embodiments of the disclosed technology.

FIG. 5 shows a dress created from the man's shirt in embodiments of the disclosed technology. Here, the dress can be seen with parts of what was the placket 30 of the shirt 10 at the front side of the skirt 18 and at the back side of the torso region 80. The torso region 80 and skirt 18 are now together as one unit, creating the dress with, in embodiments, a collar 20 from the collar for the shirt at a top of the torso.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A method of making a dress from a shirt having a single longitudinal placket extending from a top end to a bottom end of the shirt, the method comprising the steps of:

severing from said shirt a longitudinal length thereof, thereby dividing the longitudinal placket into a first portion and a second portion, said first portion forming part of said longitudinal length and extending transverse to, and to a top side and bottom side of said longitudinal length and said second portion remaining in a portion of said shirt other than said longitudinal length subject to said severing;

from said portion of said shirt other than said longitudinal length subject to said severing, cutting out a torso section of a dress comprising said second portion of said longitudinal placket;

rotating said longitudinal length with respect to said torso section and reconnecting said torso section with said longitudinal length to form a resulting dress, such that following said reconnecting said first portion of said longitudinal placket is on a front side of said resulting dress and said second portion of said longitudinal placket is on a rear side of said resulting dress.

2. The method of claim 1, wherein said longitudinal length of said shirt subject to said severing becomes a skirt section of said dress.

3. The method of claim 2, wherein said longitudinal length of said shirt subject to said severing is from a bottom-most portion of said shirt, said bottom being defined as a side which is generally furthest from a collar or head opening of said shirt.

4. The method of claim 1, wherein before or during said step of reconnecting, pleats in said longitudinal section are created.

5. The method of claim 1, wherein buttons on said first portion of said longitudinal placket and on said second portion of said longitudinal placket are functional to open and close said first and second portions of said longitudinal placket, respectively.

6. The method of claim 5, further comprising:

disconnecting a collar of said shirt from said shirt;

turning said collar around 180 degrees relative to said torso section of said dress, such that an opening of said collar is on said front side of said dress, opposed to said rear side including said second portion of said longitudinal placket; and sewing said collar to said torso section of said dress to become a collar of said dress.

7. The method of claim 5, wherein a collar of said shirt is cut as a unitary piece with said torso of said dress, said collar attached to said torso such that said collar covers a part of said torso excepting for said placket of said torso.

8. A dress, comprising:

a skirt formed from a section of a shirt which was longitudinally cut across a length thereof, said skirt including a first portion of a longitudinal placket of said shirt; and a torso section having a width, at least in part, less than that of said skirt, said torso section including a second portion of said longitudinal placket of said shirt, wherein said first portion of said longitudinal placket is on a front side of said dress, and said second portion of said longitudinal placket is on a rear side of said dress.

9. The dress of claim 8, wherein said skirt and said torso section are from the same said shirt and pleats are created which extend to where said skirt and said torso section join, such that said longitudinally cut portion of said shirt has a smaller longitudinal width where joining with said torso section and a larger longitudinal section at a side opposite where joining with said torso.

10. The dress of claim 9, wherein said skirt has a widest width substantially equal to that of said shirt.

11. The dress of claim 10, wherein said first portion of said longitudinal placket disposed on said skirt and said second portion of said longitudinal placket disposed on said torso section are functional to open and close.

12. The dress of claim 11, wherein a collar of said shirt is disconnected from said shirt and is sewn to said torso section of said dress to become a collar of said dress, wherein an opening of said collar is disposed on said front side of said dress, opposite to said second portion of said longitudinal placket disposed on said rear side of said dress.

* * * * *